US005282583A

United States Patent [19]

Högberg

[11] Patent Number: 5,282,583

[45] Date of Patent: Feb. 1, 1994

[54] AUTOMATIC ROLL-SHIFTING ROLL STAND

[75] Inventor: Hans Högberg, Åmål, Sweden

[73] Assignee: Amal Aktiebolag, Åmål, Sweden

[21] Appl. No.: 966,481

[22] Filed: Oct. 26, 1992

[30] Foreign Application Priority Data

Nov. 1, 1991 [SE] Sweden ..... 9103201

[51] Int. Cl.[5] ..... B65H 19/16

[52] U.S. Cl. ..... 242/58; 242/58.6

[58] Field of Search ..... 242/58, 58.1, 58.2, 242/58.3, 58.4, 58.5, 58.6, 68.4, 54 R

[56] References Cited

U.S. PATENT DOCUMENTS

| | | | |
|---|---|---|---|
| 2,196,612 | 4/1940 | Scott | 242/58.1 |
| 3,236,470 | 2/1966 | Huck et al. | 242/58.3 |
| 3,904,142 | 9/1975 | Corse | 242/58.3 |
| 4,564,150 | 1/1986 | Keene et al. | 242/58.1 |
| 4,673,142 | 6/1987 | Keene et al. | 242/58.3 |

FOREIGN PATENT DOCUMENTS

| | | | |
|---|---|---|---|
| 0441152 | 1/1991 | European Pat. Off. . | |
| 58-125551 | 7/1983 | Japan | 242/58 |
| 524531 | 8/1972 | Switzerland . | |
| 1389651 | 4/1975 | United Kingdom | 242/58 |
| 2204026 | 11/1988 | United Kingdom | 242/58.1 |

*Primary Examiner*—John M. Jillions
*Assistant Examiner*—John P. Darling
*Attorney, Agent, or Firm*—Nikaido, Marcelstein, Murray & Oram

[57] ABSTRACT

A roll stand is designed to unwind a material web (60) to a printing machine (2) or other production machine from an unwinding roll (13) in the roll stand and for a stoppage-free automatic shifting to a new roll (5), when the unwinding roll has been emptied to the desired degree. In accordance with the invention, tension is detected in the material web, which while braked in the roll stand is fed into the production machine. Based on that detection, the power supplied to or from a power receiving or power supplying system is regulated in such a way that the tension in the material web, which is fed in to the production machine, is kept constant.

8 Claims, 4 Drawing Sheets

AUTOMATIC ROLL-SHIFTING ROLL STAND

TECHNICAL FIELD

The present invention relates to a roll stand, designed for an unwinding of a material web to a printing machine or other production machine from an unwinding roll in the roll stand and for a stoppage-free, automatic shifting to a new roll, when the unwinding roll has been emptied to the desired degree. The invention also relates to a method of unwinding and shifting a material web.

BACKGROUND ART

Generally automatic roll-shifting roll stands are used for high speed rotational printing machines. These automatically operating roll stands are designed in such a way, that when the unwinding roll almost is finished, the new roll automatically or through manually actuated signals will start rotating, driven either by central means or by means of driving belts, which are pressed against the periphery of the roll. Well-tried and functioning systems are used to carry out the joining, the so called flying pasting.

For the required synchronization between the speed of the unwinding web and the circumferential speed of the new roll conventional electronic comparative systems are used comprising pulse transducers, current converters and similar components. These systems are comparatively complicated and are not capable of ensuring a complete synchronization. Also, often various control systems are used for the braking and the acceleration, which during various phases are required in connection with the shifting process, which provides an additional complicating factor.

Also, sometimes it is necessary to load the roll stand laterally and not, as is the conventional way to do it, between the printing units and then forward towards that roll stand which belongs to the printing machine. The reason for this is a desire to build the entire plant more compact, which however makes it more difficult to simultaneously also obtain an uncomplicated yet very efficient roll shifting.

BRIEF DISCLOSURE OF THE INVENTION

The object of the present invention is to provide improvements as to an apparatus and a method of the type described in the preamble. This and other objects can be attained in accordance with what is set forth in the accompanying patent claims.

Additional characterizing features and aspects as well as advantages of the invention are mentioned in the following description of a preferred embodiment.

BRIEF DESCRIPTION OF THE DRAWINGS

The preferred embodiment of the invention will in the following text be described in more detail, reference being made to the enclosed drawings, in which:

In FIG. 1 most components and in FIG. 4 some components, which form parts of the equipment, are shown only schematicly. However, it is true that also in FIG. 3 only those elements, which are important in order to understand the principles of the invention are shown, while other details have been omitted in order to show what is essential according to the invention more clearly.

DESCRIPTION OF A PREFERRED EMBODIMENT

Figure 1:
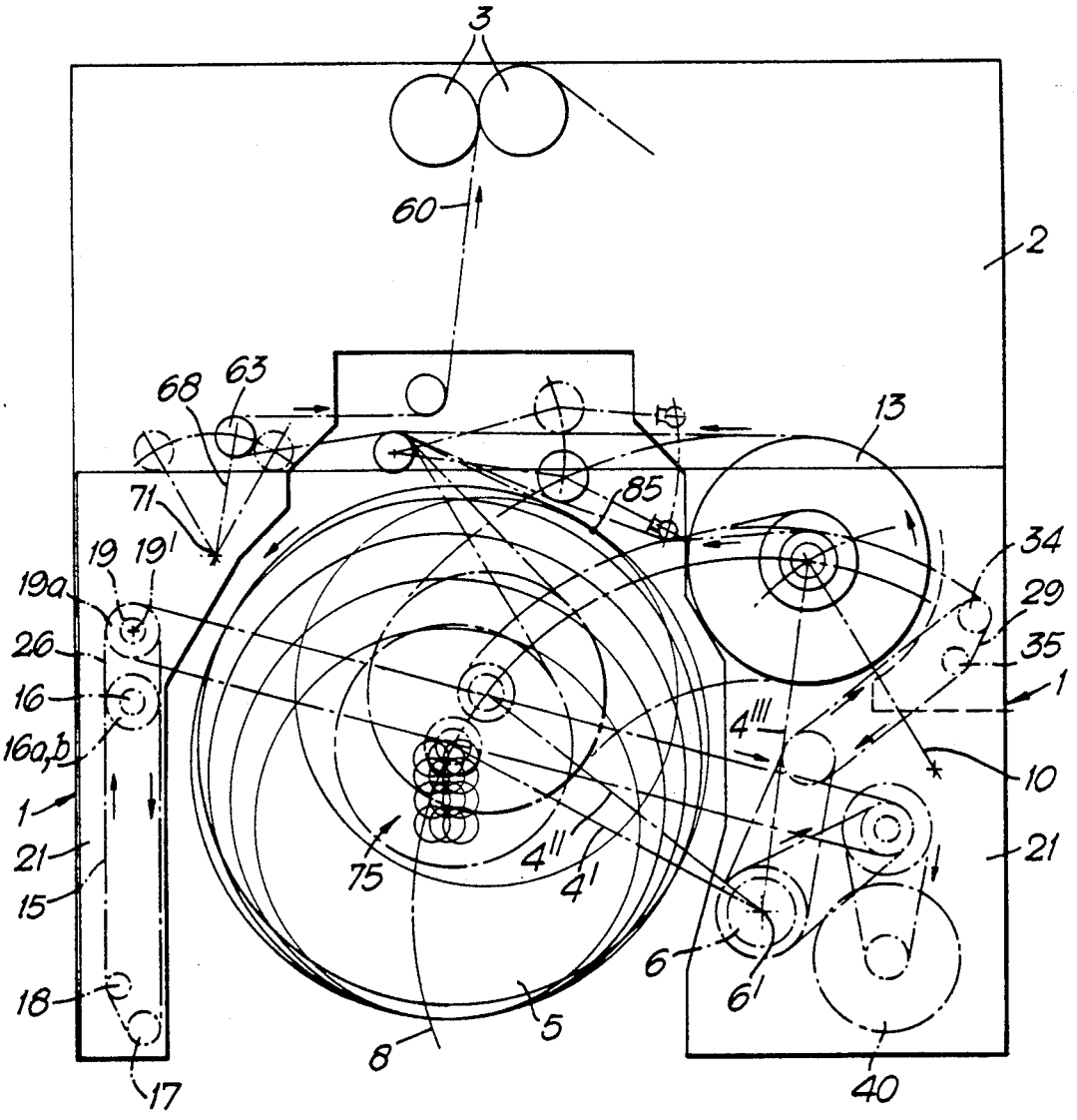
FIG. 1 schematically illustrates a roll stand according to the invention and the main components of the apparatus.

With reference first to FIG. 1, a roll stand is generally designated 1 and a printing machine is designated 2, the latter being mounted above the roll stand. Two printing cylinders 3 in the printing machine are shown.

Figure 3:
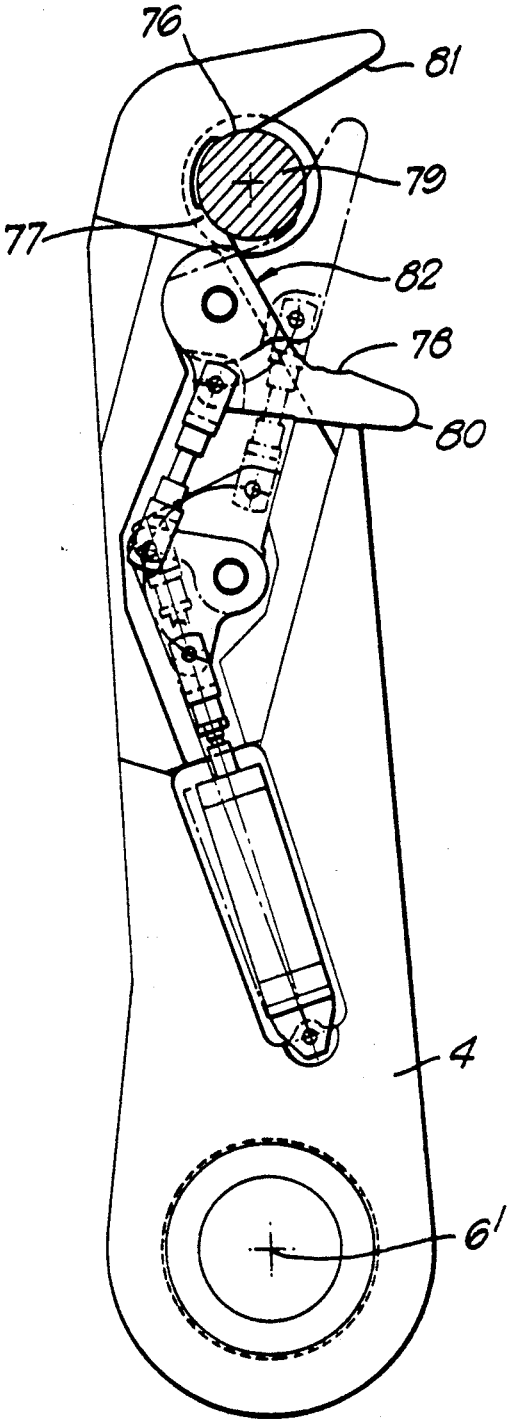
FIG. 3 is a lateral view of one roll arm of the apparatus.

Two first roll arms 4 are mounted in roll stand 1, one on each side of a first web material roll, which generally is designated 5 and which below is called a "new roll". The design of the first roll arms 4 will be explained in more detail with reference to FIG. 3. First roll arms 4 are mounted in a stand 21 and pivoted on a horizontal first shaft 6 about a fixed pivot 6' by means of a shifting device 7, shown schematically in FIG. 4, the center of new roll 5, supported by roll arms 4, being able to occupy various positions along a circular arc 8. In FIG. 1 a few of the possible positions of the roll arms are shown by dashed lines 4", 4", 41'".

Figure 4:
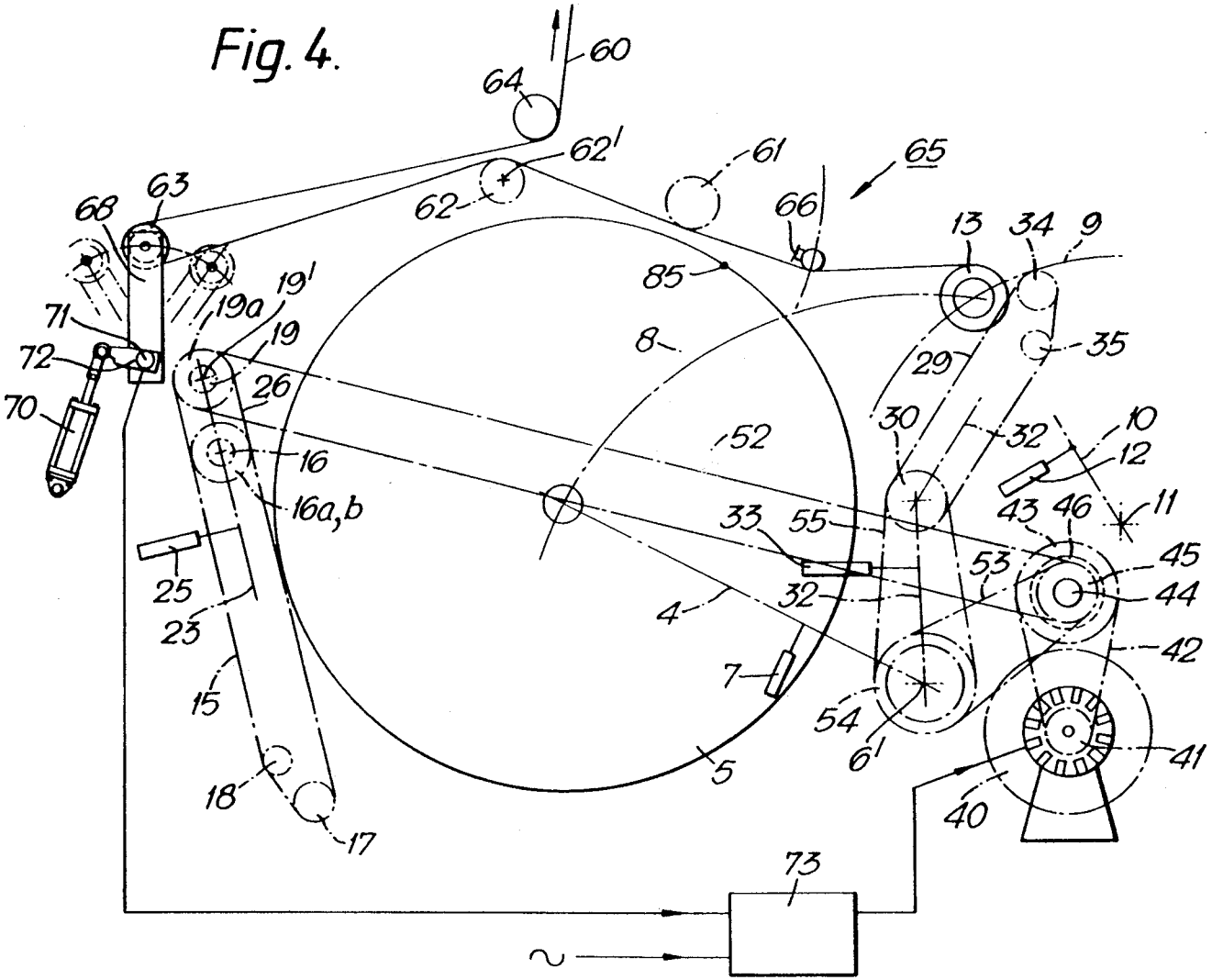
FIG. 4 illustrates the method according to the invention immediately before the roll shifting; and also in this figure the control system according to the invention is shown schematically.

Two additional roll arms 10 are schematicly shown in FIGS. 1 and 4 by a dashed line. These additional arms, which are not shown in FIG. 2, have a fixed pivot 11 and can be pivoted about this fixed pivot by means of a pneumatic cylinder 12. They are designed to hold an unwinding roll 13. Since the latter is considerably lighter than new roll 5, these arms do not have to be made as strong as first roll arms 4, but for the rest they can be designed in a similar way. The central point of the center of unwinding roll 13, when this roll is retained by additional roll arms 10, is positioned along the above-mentioned circular arc-shaped line 8. In order to remove the so-called residue roll, (i.e., the unwound roll comprising a bobbin with a small amount of residual web material), roll arms 10 can be swung out from stand 21, the roll center following a circular arc 9.

Figure 2:
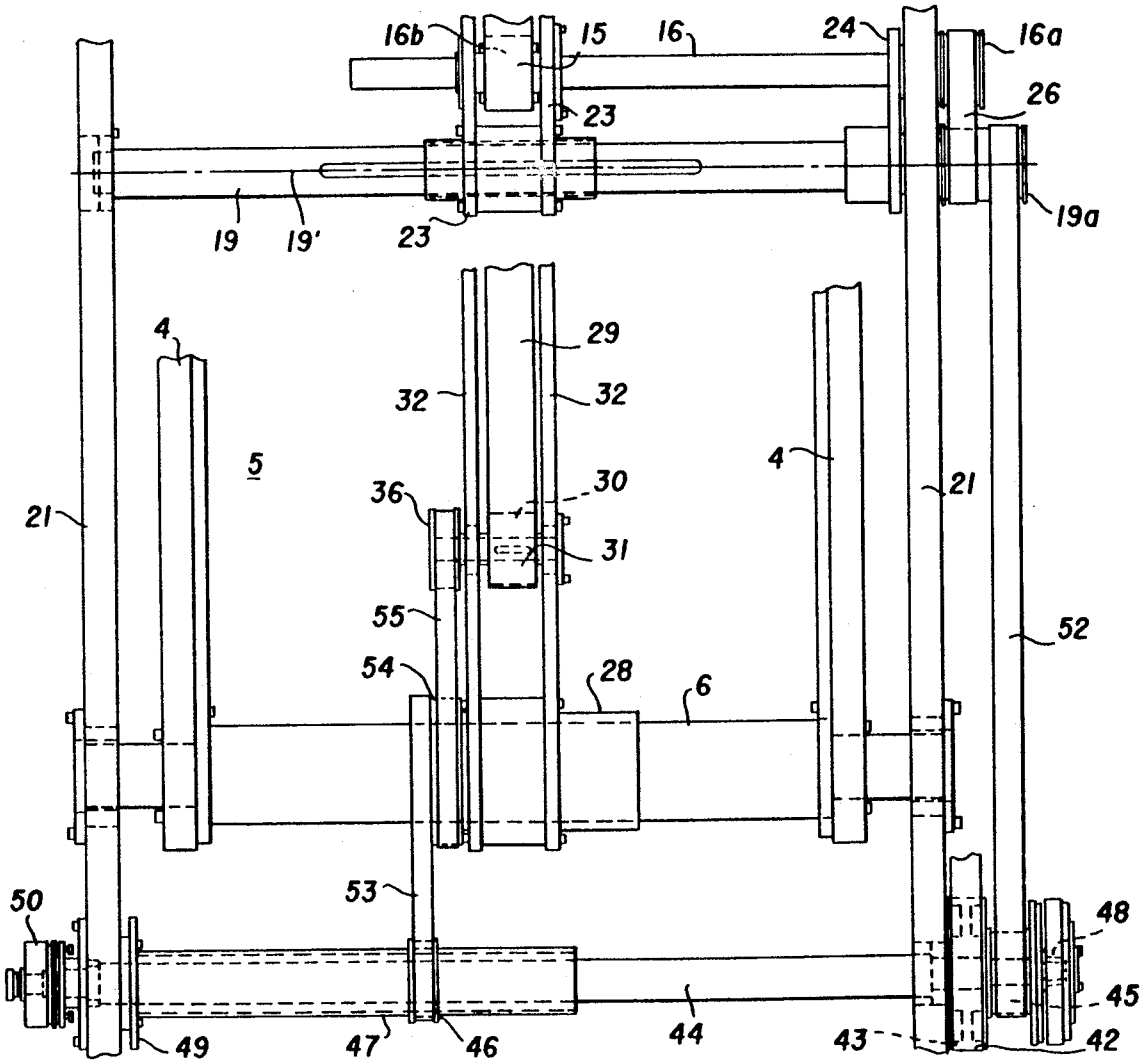
FIG. 2 is a top view of the roll stand.

A first brake and acceleration device, designed to brake and accelerate new roll 5 is designated 15. This device is a belt—in this text called a brake/acc belt—and can run about a belt pulley 16*b*, which is attached to a driving shaft 16, and in a path between pulley 16*b*, a guide roller 17 and a stretching roller 18. Driving shaft 16 and rollers 17, 18 are mounted in two long and narrow elements on each side of brake/acc belt 15, which elements jointly form a brake/acceleration arm 23, which in FIGS. 1 and 4 is shown only, schematically by a dashed line. In FIG. 2 the portion of the elements, which form brake/acc-arm 23 is shown. Furthermore, driving shaft 16 is mounted in an end plate 24. A rotary shaft 19 is mounted in stand 21. Brake/acc-arm 23 as well as end plate 24 are fixedly attached to rotary shaft 19. Brake/acc-arm 23 can be rotated about central axis 19' of rotary shaft 19 by means of a pneumatic cylinder 25.

On one end of driving shaft 16 a gear belt pulley 16*a* is fixedly attached, and on one end of rotary shaft 19 a wider gear belt pulley 19*a* is rotatably mounted on rotary shaft 19. Gear belt pulleys 16*a*, 16*b* and 19*a* for the rest have the same size, and between gear belt pulleys 19a and 16a there is a gear belt 26, which completes a gear changefree transmission between gear belt pulley 19a and brake/acc-belt 15.

A second brake belt 29 designed to brake the unwinding roll 13 is designed to run about a driving belt pulley 30, driving shaft 31 of which is mounted in two long and narrow plate elements, which jointly form a second brake arm 32, which is attached to a sleeve 28 on said first shaft 6 and can be rotated with said sleeve about fixed pivot 6' of shaft 6 by means of a pneumatic cylinder 33. Brake belt 29 also runs about a guide roller 34 and a stretching roller 35 at the end of said second brake arm 32. Driving shaft 31 is mounted in brake arm 32 and has a gear belt pulley 36 mounted at one of its ends.

A direct current machine is designated 40. This machine is designed to function as a motor as well as a generator. The machine is supplied, when it functions as a motor, with a field current from a control unit 73, FIG. 4. The latter comprises rectifiers and additional control equipment, which can be of generally known type, (e.g., a thyristor control device having a four quadrant-current direction unit with refeeding to the power supply), when the machine functions as a generator. The outshaft of the direct current machine has a gear belt pulley 41, which via a gear belt 42 is coupled to a first gear belt pulley 43 on an intermediate shaft 44. On the same intermediate shaft 44 there is at one end a second gear belt pulley 45 and on a sleeve 47, which surrounds a portion of the opposite part of intermediate shaft 44, there is a third gear belt pulley 46. First gear belt pulley 43 is larger than said second and third gear belt pulley 45, 46 and is through a head coupling permanently mounted to rotate jointly with intermediate shaft 44. Second gear belt pulley 45 can be switched on to mesh with intermediate shaft 44 through an axially controlled on and off-switchable coupling 48.

Sleeve 47 can through a coupling 50 be rotated jointly with intermediate shaft 44 about its rotation axis and thereby drive said third gear belt pulley 46, which is fixedly attached to sleeve 47. Also, a disk brake 49 is used, which quickly will brake sleeve 47 and gear belt pulley 46, when sleeve 47 is switched off from its mesh with intermediate shaft 44.

A long gear belt 52 runs between the second gear belt pulley 45 on intermediate shaft 44 and gear belt pulley 19a on guide shaft 19 in brake/acc-arm 23, which belongs to new material roll 5. Also, a gear belt 53 runs between third gear belt pulley 46, which is mounted on sleeve 47 on intermediate shaft 44 and a gear belt pulley 54 on sleeve 28 on first shaft 6, and from the same gear belt pulley 54 a gear belt 55 runs to gear belt pulley 36 on driving shaft 31 of second brake belt 29.

A material web is designated 60. This web can for example, be made of a web material (e.g., paper, cardboard, a plastic material or of a composite material). Between unwinding roll 13 in the roll stand and printing cylinders 3 in printing machine 2 material web 60 passes a knife roller 66, a pressure roller 61, a guide roller 62, a pendulum roller 63 and a guide roller 64. Pressure roller 61 is a part of a shifting mechanism, generally designated 65. In this shifting mechanism, which can be designed in a conventional way and the design of which is not a part of the present invention, also a knife roller and a knife 66 are included in a known way. The shifting mechanism 65 can be rotated about a fixed pivot 62'.

Pendulum roller 63 is rotatably mounted on a pendulum arm 68, designed in a way known per se and rotatable about a fixed pivot 71. An air cylinder 70 is designed to, jointly with the tension in material web 60, which influences pendulum roller 63, influence pendulum arm 68 in order to retain the same in a certain neutral position or zero-position. The deviation of pendulum arm 68 from this zero-position is detected in a sensor 72, which depending on the position of the pendulum arm emits signals to control unit 73 in order to adjust the direct current machine 40.

The mode of operation of the equipment is as follows: First the way in which roll stand 1 is loaded with a new roller 5 will be explained and then the way in which the shifting takes place and the way in which the circumferential speeds of the new roll and unwinding roll are synchronized will be explained, the joining of the cut final end of the old roll to the starting end of the new roll being done without problems.

It is assumed that in the starting situation, unwinding roll 13 is in its unwinding position and material web 60 is being unwound from roll 13. Roll 13 is supported by second roll arms 10. The unwinding is done, since printing cylinders 3 pull material web 60, while brake belt 29 brakes, which is pressed against the periphery of roll 13 by means of second brake arm 32 through pneumatic cylinder 33. The braking moment is transmitted through gear belt 55, gear belt pulley 54, gear belt 53, gear belt pulley 46, sleeve 47, coupling 50, intermediate shaft 44, gear belt pulley 43, gear belt 42 and gear belt pulley 41 to direct current machine 40. The latter functions as a generator or a motor (if the friction is larger than the web tension), the braking moment resulting in a certain electric power, which is fed to the power supply, or alternatively is removed from the power supply, via control unit 73, which controls direct current machine 40 depending on the deflection of pendulum arm 68, in order to make pendulum arm 68 strive to reach the set zero-position through an adjustment of the braking action of direct current motor 40 or alter natively through a driving on roll 13.

Before loading a new roll, roll arms 4 are standing in their raised position. New roll 5 is introduced on a carriage without a spindle in it. The roll is positioned correctly in an axial position. The two roll arms 4 are lowered to such an extent, that they, when they straddle roll 5 on its two sides, pass the center of the roll, the position of which depending on the diameter of roll 5 may correspond to any of the smaller circles of the group of circles 75. Spindle 79 then is introduced into the roll center, whereupon roll arms 4 are raised again to provide the spindle with two support surfaces 81, 82, the spindle then contacting two lips 76, 77 on each side (FIG. 4), spindle 79 thereafter being fastened in this position by means of a third lip 78 on two rotatable caps 80. If a roll arm is provided with said lips 76, 77 and support surfaces 81, 82, the requirement as to exactness of the lateral positioning of roll 5 will of course not be very large, since the roll due to a cooperation between support surfaces 81, 82, rollers 76, 77 and spindle 79 will be automatically centered, when roll arms 4 are being lifted, and subsequently spindle 79 and then also roll 5 can be fixed in the occupied position, aided by caps 80 and lips 78.

Roll arms 4 lift new roll 5, until its movement automatically stops in an upper position, in which the periphery of roll 5 has reached point 85, which corresponds to the shifting position. The carriage, on which new roll 5 has been introduced in a lateral direction into roll stand 1, e.g. through an entirely axial movement. can now be removed. Simultaneously the unwinding of roll 13 in its unwinding position continues, the tension in material web 60 being kept constant by means of braking belt 29 in the way described above.

When roll 13 has been unwound with, only a small residue remaining, a manual or automatic shifting command is issued. Brake/acc-arm 23 is rotated counterclockwise about its fixed pivot 19' by means of pneumatic cylinder 25 (FIG. 4) in order to press brake/acc-belt 15 against the periphery of new roll 5. Coupling 48 is now activated—initially with a slippage in order to start flexibly—to establish a driving-line between direct current machine 40 and brake/acc-belt 15 via gear belt 42 and the large gear belt 52 via gear belt pulleys 43 and 45 on intermediate shaft 44. Gradually new roll 5 starts rotating. This means that power must be taken from the braking power of unwinding roll 13 in order to accelerate new roll 5. In case this power is not sufficient, direct current machine 40 changes from functioning as a generator to a motor. All the time pendulum arm 68 with an adjusted pressure on air cylinder 70 controls via sensor 72 and control unit 73 direct current machine 40, if it is to function as a motor or as a generator and how much power will be consumed or returned in order to balance the pendulum arm in its neutral position and thereby keep the web tension constant. The friction in the transmission elements also influences the operation of direct current machine 40.

Thus, in order to accelerate new roll 5 partly the power which is obtained through the braking of unwinding roll 13 by means of brake belt 29 via gear belts 55 and 53 and partly possibly also the power which is obtained from direct current machine 40, which then is functioning as a motor, via gear belt 42, is utilized. The driving moment of brake belt 29 and direct current machine/motor 40, or the braking moment is collected in intermediate shaft 44, and from the latter the collected driving moment is transmitted to brake/acc-belt 15 via the long gear belt 52. Thus, brake/acc-belt 15 and brake belt 29 are during this phase simultaneously meshed and cause an acceleration and a braking respectively of new roll 5 and unwinding roll 13 respectively, until new roller 5 has obtained the same circumferential speed as unwinding roll 13.

When the two rolls 5 and 13 have obtained the same circumferential speed and the requirements as to a shifting have been met, shifting mechanism 65 starts its operation. The shifting arm with knife 66 and pressure roller 61 is pivoted from its upper position in a clockwise direction towards the material web to the shifting position. Pressure roller 61 presses the unwinding paper web against the circumference of new roll 5, the starting end of which has been treated in a known way with an adhesive material, in order to join the final end of the unwinding web and the starting end of new roll 5, said final end subsequently being cut off and new roll 5 starting to be unwound.

As soon as the material web has been cut off by means of knife 66, coupling 50 removes the driving line between braking belt 29 and intermediate shaft 44 and subsequently the residue roll via the second roll arms 10 is braked quickly by means of brake 49.

No later than when the knife has cut off the final end, belt 15 will change from accelerating to braking, the braking moment being controlled by the web tension and adjusted through a sensing with control unit 73 and direct current machine 40, in a way which is analogous to what has been described above with reference to the control of the braking of unwinding roll 13.

Second roll arms 10 are now swung clockwise out of roll stand 1, the center following circular line 9, and subsequently the residue roll, held by arms 10, as well as the ancillary spindle are removed, and arms 10 are subsequently returned to the position shown in FIGS. 1 and 4. When new roll 5 has been unwound to a certain diameter, it will be moved, through a pivoting of first roll arms 4, the axis of the roll spindle following circular path 8, to the crossing with circular path 9, in which point the first roll arms leave the new roll to second roll arms 10. During this movement in its entirety second brake/acc-arm 23 will follow through a rotation about its fixed pivot 19', and when new roll 5 has reached its unwinding position in said crossing point between circular paths 8 and 9, when it becomes "new" unwinding roll 13, second brake arm 32 is swung counter-clockwise through a rotation about fixed pivot 6', which is used also by first shaft 6, and subsequently brake belt 29 will brake new unwinding roll 13. In this connection first brake/acc-arm 23 will be returned to its vertical starting position (FIG. 1) through a rotation about fixed pivot 19', the braking of unwinding roll 13 completely being carried out by braking belt 29 instead with a control in the way already described above. Coupling 48 releases braking belt 15 from intermediate shaft 44. Thus, a function cycle has been concluded.

To sum up, the present invention is based on the following principles:

The web tension is used as a control means to adjust the brake and acceleration devices. The tension is detected by means of devices designed for this purpose, which according to the preferred embodiment comprises a pendulum roller on a pendulum arm as well as a sensor to detect the deviation of the pendulum arm from a zero-position. The web tension can be adjusted using the pressure in an air cylinder. Also, instead of a pendulum arm other detection means can be used, e.g. a load cell. Said tension detection regulates the power transfer to and from power receiving and power providing devices, the tension in the material web, which is fed into the production machine being kept constant. In accordance with a preferred embodiment the power receiving or power providing device is a direct current machine, which can be operated alternatingly as a motor or as a generator. Also, it is possible in principle to use an induction motor, and instead of a current converter in the control unit a four quadrant-frequency converter can be used, having a refeeding to the power supply, or any other suitable control unit. Also, it is possible to utilize a driving shaft, which is common to the entire printing machine (production machine) via a servo-mechanism, which allows a receiving of power from or a supply of power to the driving shaft. The servo-mechanism may in this instance be a differential gear, regulated by for example a servo-motor and controlled by the device which detects the web tension, i.e. the pendulum arm or the like. Irrespective of the type of web tension detection and power receiver/power supplier used it can be stated, that the web tension detector records the result of the effects from the braking of the roll and the rolls respectively and from the acceleration of the new roll and other disturbances respectively, (e.g., friction and speed alterations), and in this way the web tension can be kept constant, since the power receiving or power supplying device is caused to receive or supply power.

During the shifting process a mechanical coupling is used, having the same transmission ratio between the braking and acceleration devices, influencing the two rolls in order to make them keep exactly the same circumferential speed. As soon as the shifting has been done, this mechanical connection between the peripheries of the rolls via mechanical transmission devices is broken, and the unwound residue roll is braked quickly.

Also, an important feature of the invention is that in order to accelerate the new roll partly, the braking moment, which is obtained from other braking devices, which are pressed against the periphery of the unwinding roll and partly additional power will be utilized, in an amount, which is regulated in order to keep the web tension constant, the two effects being collected in an intermediate shaft, which is mechanically connected to the acceleration devices which directly are pressed against the periphery of the new roll. It can be stated in a simplified way, that the roll which is being unwound by a pull in the material web from the printing machine accelerates the new roll in the roll stand, and in case this pull from the printing machine is not sufficient to accelerate the new roll without increasing the adjusted web tension—which it normally is not—the required additional moment from power supplying devices is added, which are controlled by the web tension in order to keep the web tension constant.

Some alternatives to some devices included in the equipment according to the preferred embodiment have been mentioned above. It is true that also other modifications can be used without exceeding the scope of the inventive idea. Instead of braking belts, braking rollers for example can be used; and instead of gear belts in the transmissions, chains can be used; universal joints can be used for the roll arms. The handling of the rolls when the roll stand is loaded and when the residue roll is removed can be designed in other ways than the ways described above. Thus, what is to be protected by patent is not limited in scope by the description above or the preferred embodiment.

I claim:

1. A roll stand for unwinding a material web to a production machine from an unwinding roll in the roll stand and for automatic shifting to a new roll, when the unwinding roll has been emptied, characterized by:

a) first brake and acceleration means for pressing against a periphery of the new roll in order to brake or accelerate the new roll;

b) second brake means for pressing against a periphery of the unwinding roll;

c) at least one means for receiving and supplying power from and to respectively said first brake and acceleration means and said second brake means;

d) first mechanical forcedly operated transmission means for interconnecting between said first brake and acceleration means and said second brake means in order to, before roll shifting, accelerate the new roll to the same circumferential speed as the unwinding roll;

e) second mechanical transmission means operatively positioned between said first brake and acceleration means and said second brake means, for interconnecting said first brake and acceleration means to said power receiving and supplying means when said first brake and acceleration means is pressed against the periphery of the new roll and for interconnecting said second brake means to said power receiving and supplying means when said second brake means is pressed against the periphery of the unwinding roll;

f) means for detecting tension in the material web which, while braked in the roll stand, is fed into the production machine; and g) means for regulating the power transfer to and from said power receiving and supplying means in order to keep the tension in the material web constant based on a detection by said detection means, the material web being fed into the production machine, wherein said second mechanical transmission means comprises an intermediate shaft, said intermediate shaft being interconnected to said first brake and acceleration means, to said second brake means, and correspondingly to said power receiving and supplying means when said first brake and acceleration means and said second brake means are pressing against the periphery of the new roll and the unwinding roll, respectively.

2. A roll stand according to claim 1, characterized in that said first brake and acceleration means comprises a brake belt, wherein said first brake and acceleration means is further for controllably moving said brake belt against and away from the periphery of the new roll.

3. A roll stand according to claim 1, characterized in that said second brake means comprises a brake belt wherein said second brake means is further for controllably moving said second brake belt to and away from the periphery of the unwinding roll.

4. A roll stand according to claim 1, characterized in that said power receiving and power supplying means is a direct current machine so as to operate as a motor and a generator.

5. A system for automatically unwinding an unwinding roll having a material web to a production machine and shifting to a new roll when the unwinding roll has been emptied, comprising:

a first brake and acceleration means for braking and accelerating a circumferential speed of the new roll;

second brake means for brakingly controlling a circumferential speed of the unwinding roll;

means for receiving power from and supplying power to said first brake and acceleration means and said second brake means;

first mechanical transmission means for interconnecting between said first brake and acceleration means and said second brake means so as to accelerate the new roll to the same circumferential speed as the unwinding roll before roll shifting;

second mechanical transmission means operatively positioned between said first brake and acceleration means and said second brake means, for interconnecting said first brake and acceleration means to said power receiving and supplying means when said first brake and acceleration means is pressed against the periphery of the new roll and for interconnecting said second brake means to said power receiving and supplying means when said second brake means is pressed against the periphery of the unwinding roll;

means for detecting tension in the material web while the material web, which is braked in the roll stand, is fed into the production machine; and means for regulating the power transfer to and from said power receiving and supplying means in connection with said first brake and acceleration means and said second brake means so as to keep the tension in the material web constant based on a detection by said detection means, the material web being fed into the production machine, wherein said second mechanical transmission means includes an intermediate shaft interconnected to said first brake and acceleration means, to said second brake means, and correspondingly to said power receiving and power supplying means when said first brake and acceleration means and said second brake means are pressing against the periphery of the new roll and the unwinding roll, respectively.

6. A roll stand according to claim 5, characterized in that said first brake and acceleration means includes a brake belt, wherein said first brake and acceleration means is further for controllably moving said brake belt against and away from the periphery of the new roll.

7. A roll stand according to claim 5, characterized in that said second brake means comprises a brake belt, wherein said second brake means is further for controllably moving said second brake belt to and away from the periphery of the unwinding roll.

8. A roll stand according to claim 5, characterized in that said power receiving and power supplying means is a direct current machine so as to operate as a motor and a generator.

* * * * *